United States Patent [19]

Bryant

[11] Patent Number: 4,963,410

[45] Date of Patent: Oct. 16, 1990

[54] FASTENING MECHANISM

[76] Inventor: Judson D. Bryant, 1918 Shannon Valley, Houston, Tex. 77077

[21] Appl. No.: 252,894

[22] Filed: Oct. 3, 1988

[51] Int. Cl.[5] ..... B32B 3/06

[52] U.S. Cl. ..... 428/100; 24/68 A; 24/163 R; 24/171; 24/182; 24/196; 24/265 BC; 24/265 AL; 24/265 R; 2/DIG. 6

[58] Field of Search ..... 428/100; 2/DIG. 6; 24/68 A, 163 R, 265 BC, 265 AL, 265 R, 171, 182, 196

[56] References Cited

U.S. PATENT DOCUMENTS 3,000,384 9/1961 Piers ..... 2/DIG. 6
4,273,130 6/1981 Simpson ..... 2/DIG. 6

*Primary Examiner*—Alexander S. Thomas

[57] ABSTRACT

The invention is an apparatus for securing together segments of an elongated member such as an extension cord. The apparatus includes means for engaging at least one segment of the elongated member and a band member for wrapping around additional segments of the elongated member and having surfaces that releasably adhere to maintain the segments of the elongated members in a bundle.

6 Claims, 2 Drawing Sheets

FASTENING MECHANISM

BACKGROUND OF THE INVENTION

1. Field of the Invention

The invention relates to fasteners.

2. Background

At construction sites as well as other locations, it is frequently desirable to form an extension cord, or drop cord, or the like into a compact coil for transporting or storage. There has not been available, however, a device for easily securing the coil, or bundle, that is also readily releasable and reuseable. The same need exists for transporting and storing other flexible, elongated members, such as garden hoses.

SUMMARY OF THE INVENTION

The invention is an apparatus for securing together the segments of an elongated member such as an extension cord. The apparatus includes means for engaging at least one segment of the elongated member and a band member for wrapping around additional segments of the elongated member and having surfaces that releasably adhere to maintain the segments of the elongated member in a bundle.

DETAILED DESCRIPTION OF THE DRAWINGS

At construction sites or other work sites, it is frequently useful to form elongated flexible members such as extension cords (or drop cords) into loops (or coils) for ease in storing or for transporting them from one location to another. My invention is an apparatus which offers an improvement over the prior art in that it not only holds the loop securely, but is also easily attachable, releasable and reusable.

Figure 1A:
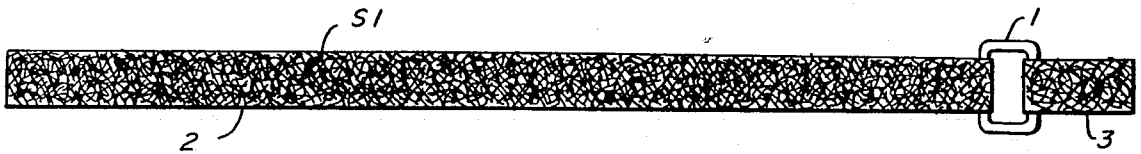
FIGS. 1A and 1B illustrate a preferred embodiment of the invention.
Figure 1B:
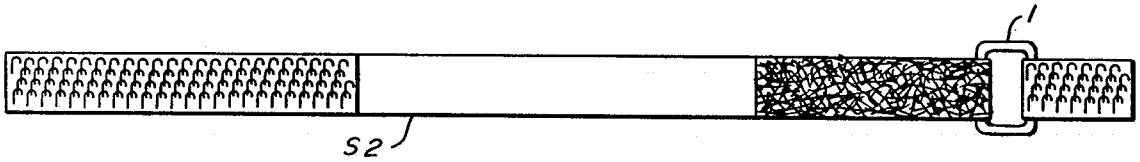

FIGS. 1A and 1B show a preferred embodiment of the invention. A band 2 is secured at one end thereof around one side of a ring member 1, which may be a rectangular-shaped cinch ring, and a band 3 is secured around the opposite side of the ring member 1. In a preferred embodiment, band 2 may be about 17 inches long by 1 inch wide and band 3 may be about 2 inches long and 1 inch wide.

The invention employs the "hook and loop" fastener technique. In the preferred embodiment, sides S1 of bands 2 and 3 comprise 'loop' tape. On side S2 of band 2 there is affixed along a portion thereof opposite the end connected to the cinch ring a strip of hook tape which, in the embodiment shown, may be about 5 inches long, and on side S2 of band 2 adjacent the cinch ring there is affixed a strip of loop tape about 4 inches long. This strip of loop tape on side S2 of band 2 may also be an extension of side S1 of band 2 which, after passing through ring 1, is folded back onto itself and sewed together. Along substantially the entire length of side S2 of band 3 is affixed a strip of hook tape. Bands 2 and 3 each extend around and rotatingly engage the cinch ring.

Figure 3:
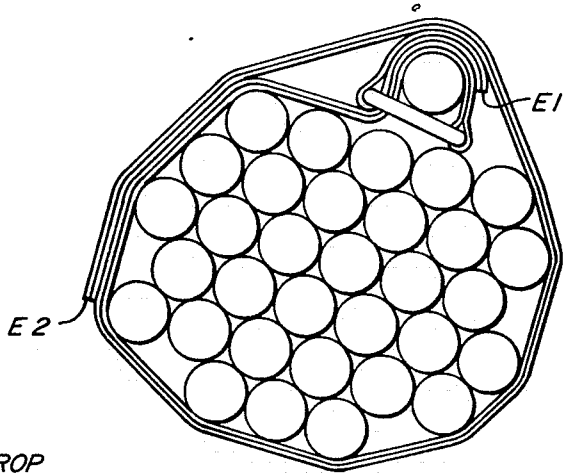
FIGS. 2 and 3 illustrate the operation of a preferred embodiment of the invention.
Figure 2:
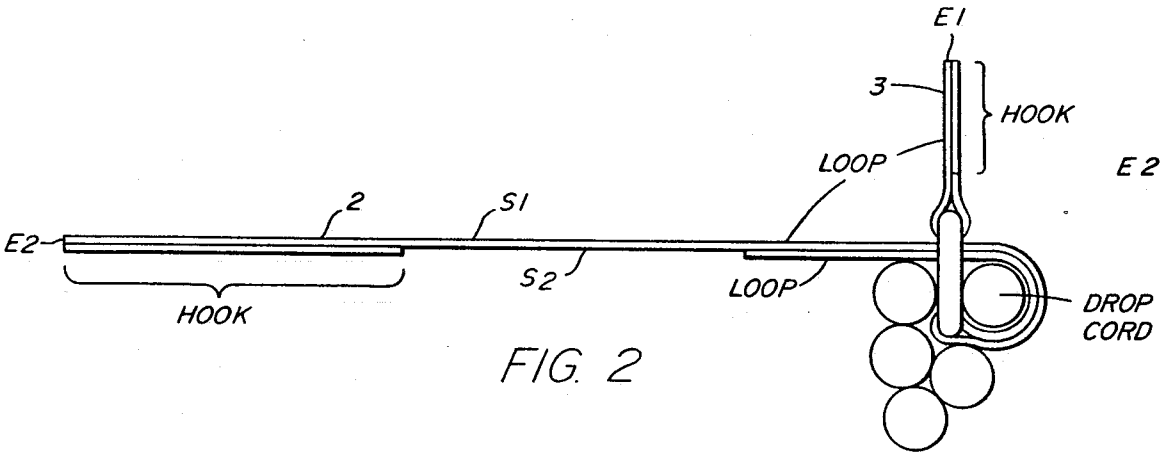

The operation of the invention is illustrated in FIGS. 2 and 3. As stated hereinabove, it is desirable to roll such elongated members as extension cords (or drop cords) and garden hoses into bundles for storing. The operation of the apparatus will be described hereinafter with reference to extension cords, for convenience, although use of the apparatus is not limited to extension cords.

As shown in FIG. 2, the end E2 of band 2 is inserted through the cinch ring, with side S2 of band 2 being on the inside of the loop formed thereby. This loop is formed around a segment of the extension cord and band 2 is pulled tight until it fits snugly around the extension cord segment. Band 3 is then wrapped around the loop formed by band 2 in the direction of the arrow (to the right as shown in FIG. 2) so that the hook surface of side S2 of band 3 adheres to the loop surface on side S1 of band 2. Band 2 is then wrapped securely around the additional segments of the extension cord, and then around band 3 and onto itself so that the hook surface of side S2 of band 2 adheres to the loop surface on side S1 of band 2, as shown in FIG. 3.

In this position, the extension cord is positioned for storage. When it is desired to use the extension cord, the apparatus is readily releasable by pulling end E2 and unwinding band 2. The apparatus may be conveniently left wrapped around an extension cord segment in the manner shown in FIG. 2, while the extension cord is in use, except that the loop in band 2 will normally be pulled tight around the section of extension cord segment and the hook surface of band 3 will be left so that it adheres to the loop surface of band 2. Band 2 may be folded back onto itself so that the hook surface on side S2 of band 2 adheres to the loop surface on side S2 thereof, to reduce any tendency for the band to become entangled while in use. The mechanism may be removed easily from the extension cord by pulling band 3 to release it from band 2, and then retracting band 2 from the cinch ring to release the extension cord.

The hook tape, the loop tape as well as the cinch ring may be obtained from VELCRO Inc.

Figure 5:
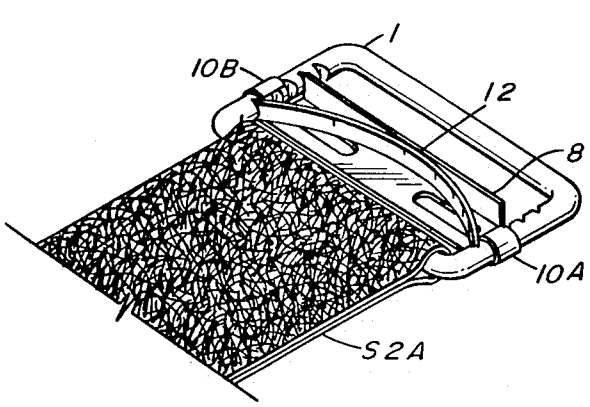
FIGS. 5 and 6 illustrate the operation of a second preferred embodiment of the invention.
Figure 4A:
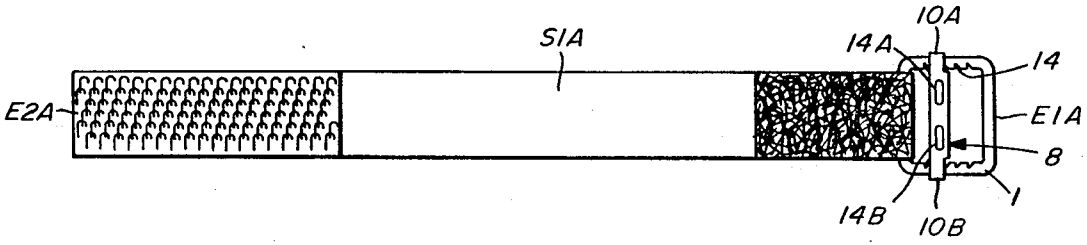
FIGS. 4A and 4B illustrate a second embodiment of the invention.
Figure 4B:
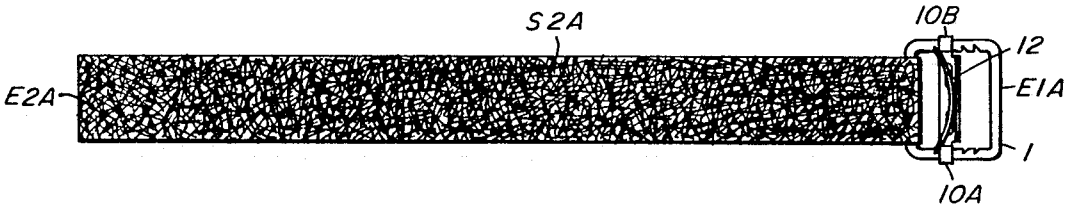

FIGS. 4A, 4B and 5 show an alternate embodiment of the invention. In this embodiment, the function performed by band 3 in the embodiment described above is performed by slide member 8. Slide member 8 includes end portion 10A and 10B which slidingly engage the cinch ring 1 on opposite sides thereof. As shown in FIGS. 4A and 4B, these two opposite sides are at the top and bottom of the cinch ring 1. The portion of the slide member 8 extending between the opposite sides of cinch ring 1 may be L-shaped, with one part of the L-shaped portion being in a plane perpendicular to the plane of the cinch ring and the other portion being parallel to the plane of the cinch ring. Spring member 12 is affixed to the part of the L-shaped part of the slide member which is perpendicular to the plane of the cinch ring, substantially at the center thereof. Spring member 12, which may be formed from spring steel, has an arcuate shape and extends between the opposite sides of the chich ring 1. On the internal surfaces of the opposite sides of the cinch ring, which as shown on FIGS. 4A and 4B are the top and bottom sides, saw-tooth notches 14 are milled so that when slide member 8 is moved toward the right as shown in FIGS. 4A and 4B, the spring member 12 will slide past the notches. When the slide member 8 is pushed toward the left, as illustrated in FIGS. 4A and 4B, the opposite ends of the spring member will catch in the saw-toothed notches and not move.

As shown in FIGS. 4A and 4B, substantially the entire length of side S2A of band 2 may comprise loop tape. Hook tape is affixed to side S1A for about a 6 inch length on the end thereof opposite the cinch ring. About a 4 inch length of side S1A adjacent the cinch ring comprises loop tape, which may consist of an extension of side S2A foulded back onto itself and sewed together.

Figure 7:
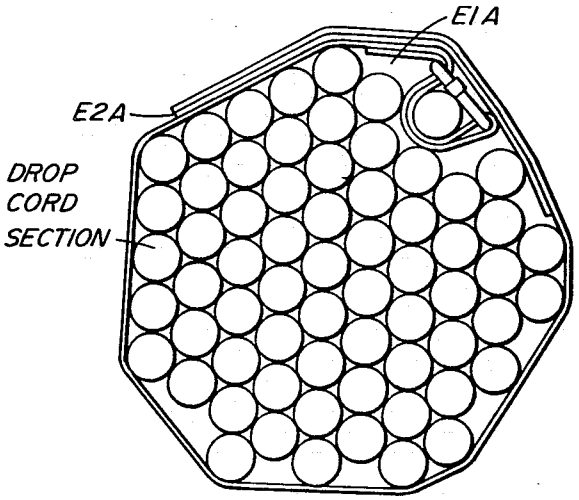
FIG. 7 shows a pictorial view of a portion of the second embodiment of the invention.
Figure 6:
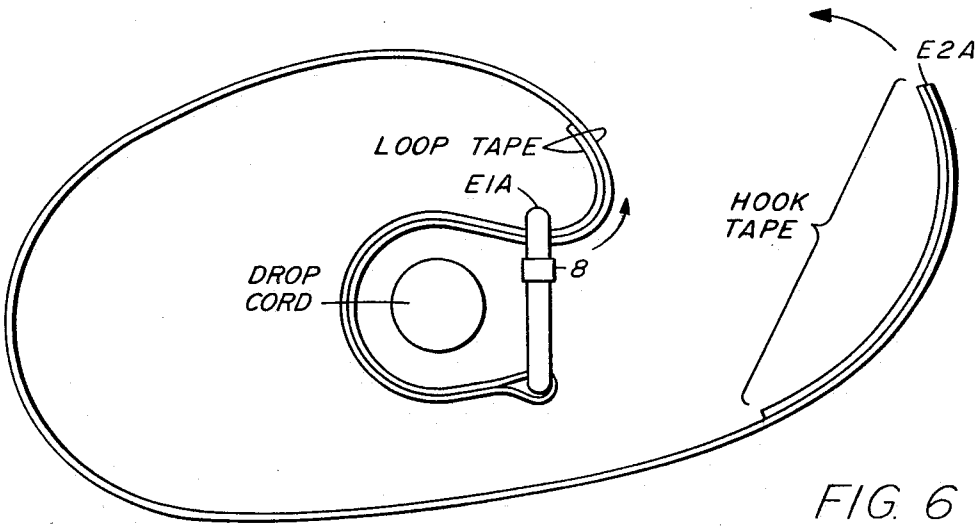

As shown in FIG. 6, this embodiment of the invention is operated by inserting the end, E2A, of the band 2 into the space between slide member 8 and the end of the cinch ring designated by E1A. The end of band 2 is inserted through this space in the direction that is into the the page as shown in FIG. 4B. Band 2 is then pulled through the cinch ring until a segment of an extension cord, or the like, is firmly gripped. The sliding member is then moved towards end E1A of the cinch ring until band 2 is firmly gripped. The spring member 12 will engage the saw-tooth notches and prevent slide member 8 from moving back and maintain the firm grip on band 2. Band 2 is then wrapped around the remaining segments of the extension cord bundle, and then around onto itself in the manner illustrated in FIGS. 6 and 7, so that the hook surface on side S1A adheres to the loop surface on side S2A.

To release the band 2 from the engagement between the slide member and cinch ring, a pointed object is inserted through aperture 14A or 14B in the slide member and the pointed object pressed against the spring member to release an end thereof from the saw-tooth notches. When the extension cord is in use the mechanism may also be left secured around one segment of the extension cord.

While the foregoing Description of the Preferred Embodiment includes detailed information which will enable those skilled in the art to practice the invention, it should be recognized that the description therein is illustrative only and that many modifications and variations will be apparent to those skilled in the art having the benefit of these teachings. It is accordingly intended that the invention herein be defined solely by the claims appended hereto and that the claims be interpreted as broadly as permitted by the prior art.

I claim:

1. Apparatus for securing together a plurality of segments of an elongated member comprising first means for securely engaging at least one of said segments; and band means attached to said first means for encircling additional segments of said elongated member, said band means having surfaces adapted so that when said band means is wrapped onto itself after encircling said additional segments, a first surface of said band means releasably adheres to the opposing surface thereof, and wherein said first means comprises a cinch ring, said band means, and a second band means, the first said band means and said second band means being attached to opposing sides of said cinch ring, and at least one segment of said elongated member is engaged by encircling said segment with the first said band means and pulling the first said band means through said cinch ring until said segment is securely embraced within the first said band means, and thereafter wrapping said second band means around the first said band means, said first and second band means having surfaces that releasably adhere to each other.

2. The apparatus of claim 1 wherein said first means is releasable.

3. The apparatus of claim 1 wherein said releasably adhering surfaces are hook and loop surfaces.

4. Apparatus for securing together a plurality of segments of an elongated member comprising first means for securely engaging at least one of said segments; and band means attached to said first means for encircling additional segments of said elongated member, said band means having surfaces adapted so that when said band means is wrapped onto itself after encircling said additional segments, a first surface of said band means releasably adheres to the opposing surface thereof, and wherein said first means comprises a cinch ring, said band means being attached to an end of said cinch ring, said cinch ring having saw-tooth notches formed in the interior surface of the two side segments thereof, and a slide member in sliding engagement with the two sides of the cinch ring, said slide member having a spring member attached thereto and adapted to engage the saw-tooth notches so as to be slidable in one direction but not in the opposite direction.

5. The apparatus of claim 4 wherein said first means is releasable.

6. The apparatus of claim 4 wherein said releasably adhering surfaces are hook and loop surfaces.

* * * * *